US005345743A

United States Patent [19]

Baier

[11] Patent Number: 5,345,743

[45] Date of Patent: Sep. 13, 1994

[54] INSULATED WINDOW ASSEMBLY WITH INTERNAL MUNTIN BARS AND METHOD OF MAKING SAME

[75] Inventor: Bruce A. Baier, Pella, Iowa

[73] Assignee: Peela Corporation, Pella, Iowa

[21] Appl. No.: 595,996

[22] Filed: Oct. 11, 1990

[51] Int. Cl.[5] ..... E06B 3/66

[52] U.S. Cl. ..... 52/455; 52/314; 52/790

[58] Field of Search ..... 52/456, 790, 304, 314, 52/398, 399, 455

[56] References Cited

U.S. PATENT DOCUMENTS

| | | | |
|---|---|---|---|
| 2,167,772 | 8/1939 | Owen . | |
| 2,828,235 | 3/1958 | Holland et al. | 52/790 |
| 2,848,762 | 8/1958 | Peterson . | |
| 3,212,179 | 10/1965 | Koblensky . | |
| 3,308,593 | 3/1967 | Smith . | |
| 3,512,320 | 5/1970 | Ferron et al. | 52/456 |
| 3,791,095 | 2/1974 | Martin . | |
| 3,946,531 | 3/1976 | Armstrong | 52/456 |
| 4,598,520 | 7/1986 | Ellstrom . | |
| 4,652,472 | 3/1987 | Davies . | |
| 4,783,938 | 11/1988 | Palmer . | |
| 4,989,384 | 2/1991 | Kinghorn et al. | 52/790 |

*Primary Examiner*—Michael Safavi

*Attorney, Agent, or Firm*—Zarley, McKee, Thomte, Voorhees, & Sease

[57] ABSTRACT

A true divided look is provided in an insulated two-pane window assembly through use of a resilient silicone foam internal muntin bar grid which is low in thermal conductivity to limit heat transfer between panes and is high in flexibility to allow for bending when forming curved shapes. The grid is secured by adhesive on one side to one pane of glass, thereby allowing natural expansion and contraction of the glass panes. The resilient muntin bar includes the resilient muntin bar being U-shaped with a base from which legs extend which are compressible and adapted to move laterally in response to pressure from the panes due to changing thermal conditions or bonding of external wooden muntin bars to the panes. Movement of the panes toward each other would be limited by bottoming out against the base of the resilient muntin bar.

14 Claims, 2 Drawing Sheets

INSULATED WINDOW ASSEMBLY WITH INTERNAL MUNTIN BARS AND METHOD OF MAKING SAME

BACKGROUND OF THE INVENTION

A true divided light window is very attractive and popular for use in homes, but is very expensive as individual panes of glass must be assembled into a window. Numerous simulated true divided lights have been provided such as represented in the Palmer U.S. Pat. No. 4,783,938, wherein an internal metal grid of muntin bars is positioned between the spaced apart panes of glass. The use of metal muntin bars causes several problems. Heat loss through the metal bars was prevented by using insulated spacers between the bars and the glass. The spacers then produced stress points in the window, and during very cold weather, breakage would occur as the panes contracted towards each other.

It is also difficult to shape the metal bars as desired to produce the more complicated grid designs including numerous curved shapes. Rattling can also be a problem with metal internal muntin bars.

What is needed then is an authentic looking internal muntin bar grid which does not have the shortcomings of the metal internal muntin bars.

SUMMARY OF THE INVENTION

An internal resilient and flexible muntin bar grid is used preferably made from silicone foam. The resilient material may be readily shaped to provide any design desired. The absence of metal avoids any loss of heat through the window. The resiliency of the internal muntin bar grid allows the panes to contract and expand naturally without setting up stress points which may cause breakage.

During the assembly of external wooden muntin bars in superimposed relationship to the internal muntin bar grid, it is necessary to apply pressure to the external muntin bars, and this pressure must be resisted between the panes to prevent breakage of the glass. The resilient muntin bar grid will absorb a certain amount of inward deflection of the panes, but will ultimately bottom out short of the panes breaking.

The preferred internal muntin bar is U-shaped with a base having spaced apart legs. The legs will compress and deflect laterally under pressure from the panes and ultimately bottom out against the base portion limiting further movement of the panes towards each other.

In very large windows, spaced apart resilient muntin bar components will be used which will give the appearance of a single muntin bar. Each component will include a base and a leg portion which is compressible and will deflect laterally.

DESCRIPTION OF PREFERRED EMBODIMENT

Figure 1:
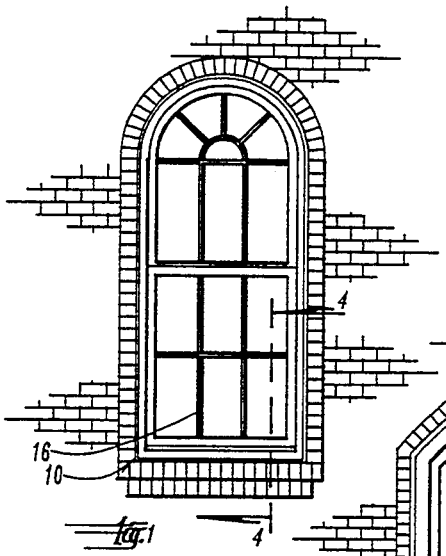
FIG. 1 is a fragmentary planned view of a window utilizing the resilient internal muntin bar grid of this invention.
Figure 2:
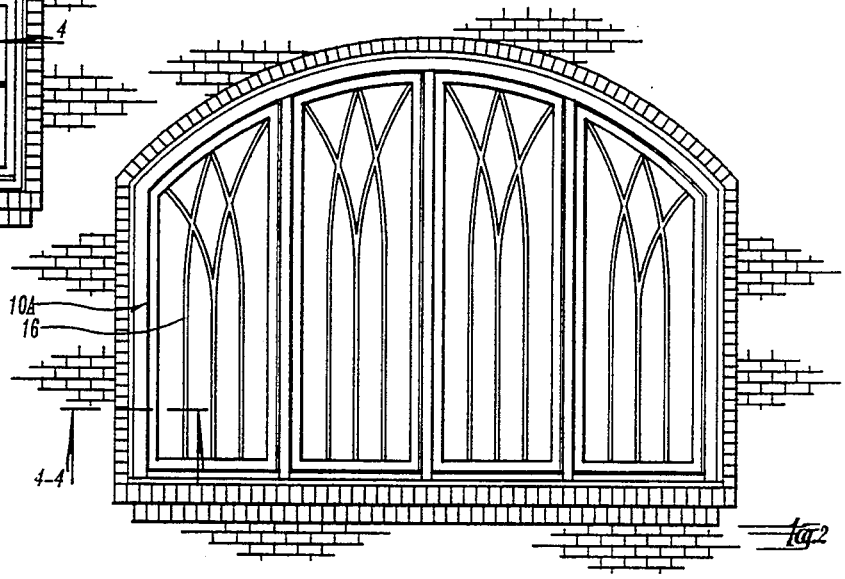
FIG. 2 is a view similar to FIG. 1 showing a different window design including curved muntin bars.
Figure 3:
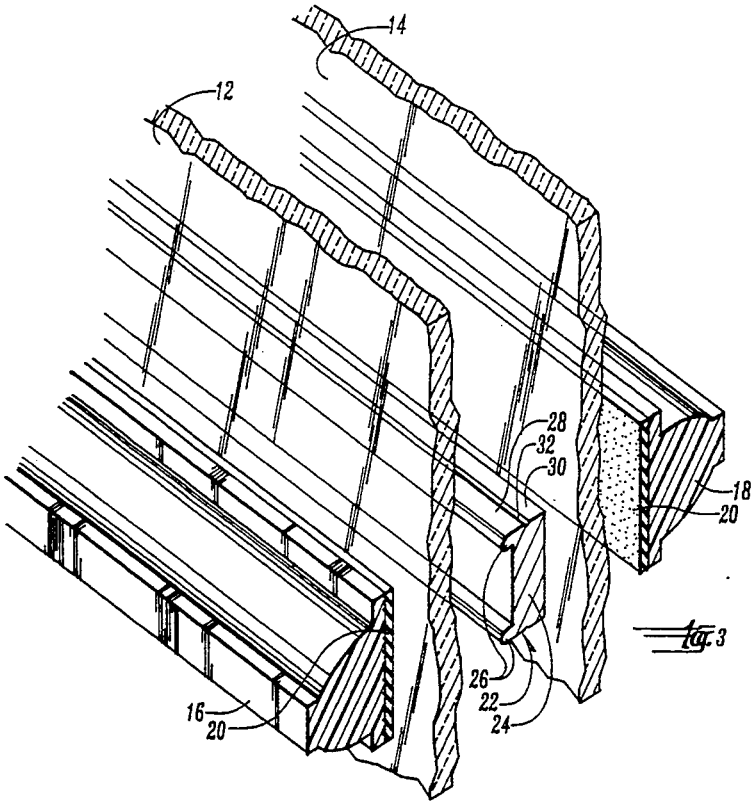
FIG. 3 is an exploded fragmentary prospective view of the window assembly.
Figure 4:
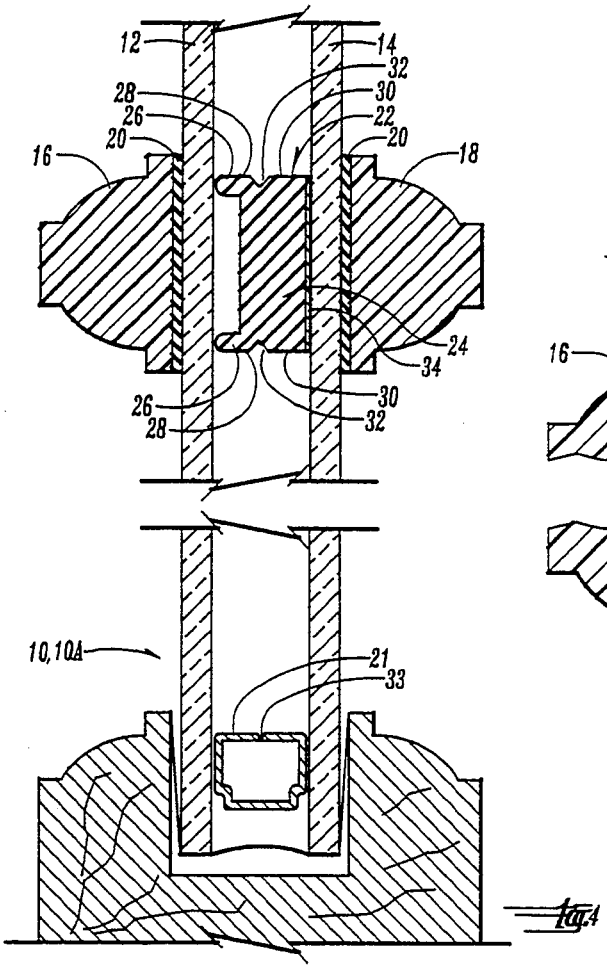
FIG. 4 is a sectional view taken along line 4—4 in FIGS. 1 and 2.

The window assembly generally referred to by the reference numeral 10 utilizing the resilient internal muntin bar grid of this invention is shown in FIG. 1. A window assembly having a different muntin bar design is referred to by the reference numeral 10A in FIG. 2.

The window assembly comprises first and second spaced apart panes of glass 12 and 14 on which wooden external muntin bars 16 and 18 are secured by adhesive 20. A perimeter spacer metal bar 21 extends between the panes and around the exterior of the window assembly.

An internal resilient muntin bar grid 22 is provided between the panes 12 and 14 in superimposed relationship to the external wooden muntin bars 16 and 18.

The internal muntin bar 22 is U-shaped and includes a base 24 with upstanding spaced apart legs 26. Legs 26 have an outer surface 28 co-planar with the outer surface 30 of the base 24, thereby giving the appearance of being a solid bar. A groove 32 extends longitudinally along the bar 22 at its center to simulate a metal muntin bar seam as seen at 33 in the metal perimeter spacer bar 21.

The muntin bar 22 is secured by adhesive 34 on the base 24 to the inside face of pane 14. The legs 26 are not secured to the inside face of the pane 12, thereby allowing natural expansion and contraction of the panes relative to each other without damaging adhesive bonds between the panes and the muntin bar. If the space between the panes 12 and 14 is filled with gas, it will also be allowed to move throughout the entire window if the muntin bar is adhesively held to one pane only on one side. Irregular breakage of adhesive if adhesive is applied to both sides of the muntin bar would lead to an unsightly appearance.

Figure 5:
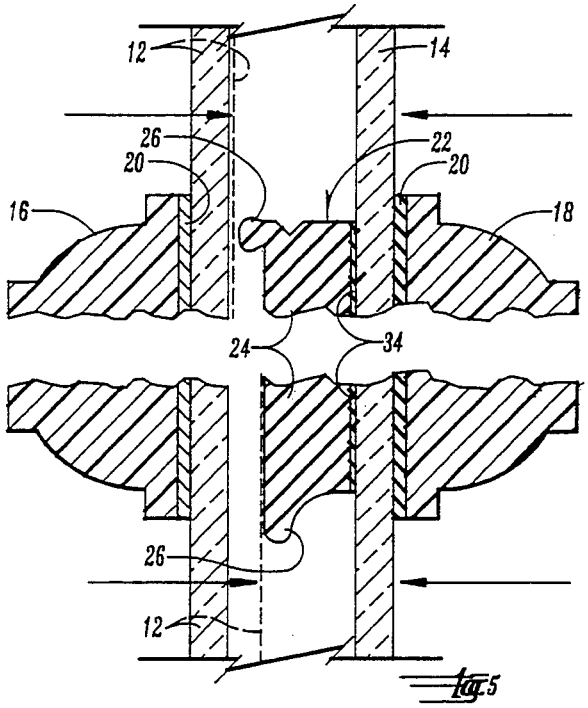
FIG. 5 is a cross-sectional view similar to FIG. 4 but showing the internal resilient muntin bar in different stages of compression during the assembly of the window.

The muntin bar 22 substantially fills the space between the panes 12 and 14, assuring an authentic true divided appearance to the window. The panes 12 and 14 will move towards and away from each other due to changing thermal conditions and during assembly of the window when pressure is applied to the external muntin bars 16 and 18 to bond the adhesive 20 to one of the panes 12 and 14. Resistance must be provided between the panes to resist this pressure. As seen in FIG. 5, the legs 26 progressively compress and deflect laterally outwardly as the panes 12 and 14 move closer together until eventually the pane 12 bottoms out on the base 24, preventing further movement of the pane 12 which would cause breakage. The resilient legs 26 permit normal thermal expansion and contraction of the panes 12 and 14 while maintaining throughout the true divided window look.

The preferred resilient material used for the muntin bar 22 is silicone foam available from Edgetech, Lauren Manufacturing Co., New Philadelphia, Ohio. This material has been used by them as a peripheral pane spacer bar and may be filled with desiccant.

Figure 6:
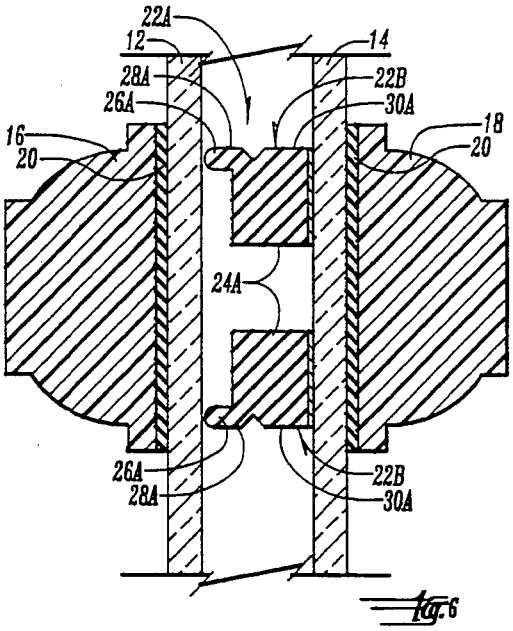
FIG. 6 is a cross-sectional view of an alternate embodiment of the internal resilient muntin bar, wherein each muntin bar comprises spaced apart component bars.

An alternate embodiment is shown in FIG. 6 wherein an internal resilient muntin bar grid 22A is shown comprising a pair of spaced apart component muntin bars 22B. This arrangement is used when the external wood muntin bar is very wide thus requiring a wider internal muntin bar. Larger windows will usually require wider muntin bars. An important advantage of using smaller spaced apart component muntin bars is that they are easier to bend when forming curved shapes such as on circle head windows. Each component resilient muntin bar 22B includes a base 24A which includes an upstanding leg 26A on the exterior side 30A of the base 24A.

Thus, it is seen that a window assembly has been provided which gives the true divided window look and is easily assembled to provide the more complicated designs which include numerous curved muntin bar shapes. The resilient silicone foam material is easily shaped as desired, as compared to the previously used metal muntin bar grid members. The problems of heat loss, stress glass breakage, and rattling are eliminated. A cushioned support is provided for pressing on the external wooden muntin bars.

What is claimed is:

1. An insulated window assembly comprising:

first and second spaced apart panes of transparent sheet material;

a perimeter spacer bar positioned between said panes and extending around the perimeter of said panes and defining two pairs of opposite sides of said window assembly; and an internal muntin bar grid disposed between said first and second spaced apart panes, said muntin bar grid being formed from a silicone foam material which is low in thermal conductivity to limit heat transfer between said first and second spaced apart panes, and is high in flexibility to allow for bending when forming curved shapes.

2. The structure of claim 1 wherein adhesive means secures said muntin bar grid to one of said first and second panes.

3. The structure of claim 2 wherein said adhesive means secures said muntin bar grid to only one of said first and second panes whereby said panes may expand apart without stressing said muntin bar grid and stressing said adhesive means.

4. The structure of claim 1 wherein said muntin bar grid is U-shaped and includes a base and oppositely disposed legs having outer ends positioned closely adjacent one of said first and second panes and with said base being positioned closely adjacent said other of said panes.

5. The structure of claim 4 wherein said oppositely disposed legs of said U-shaped muntin bar are resilient to pressure from said first and second panes.

6. The structure of claim 4 wherein said base portion of said U-shaped muntin bar grid is secured by adhesive means to one of said first and second panes.

7. The structure of claim 5 wherein said ends of said legs adjacent said other of said first and second panes allow unrestricted movement of said other pane away from said legs.

8. The structure of claim 1 wherein said muntin bar grid comprises two component bars closely spaced to appear as a single bar.

9. The structure of claim 8 wherein each of said component bars includes a base and an upstanding leg extending between said first and second panes.

10. The structure of claim 9 wherein said leg has an outside wall in the plane of an outside wall of said base whereby said component bars give the appearance of a single muntin bar.

11. An insulated window assembly comprising:

first and second spaced apart panes of transparent sheet material;

a perimeter spacer bar positioned between said panes and extending around the perimeter of said panes and defining two pairs of opposite sides of said window assembly;

an internal muntin bar grid disposed between said first and second spaced apart panes, said muntin bar grid being formed from a nonmetallic material which is low in thermal conductive to limit heat transfer between said first and second spaced apart panes and adhesive means securing said muntin bar grid to only one of said first and second panes whereby said panes may expand apart without stressing said muntin bar grid and stressing said adhesive means.

12. An insulated window assembly comprising:

first and second spaced apart panes of transparent sheet material;

a perimeter spacer bar positioned between said panes and extending around the perimeter of said panes and defining two pairs of opposite sides of said window assembly;

an internal muntin bar grid disposed between said first and second spaced apart panes, said muntin bar grid being formed from a silicone foam material which is low in thermal conductivity to limit heat transfer between said first and second spaced apart panes, and is high in flexibility to allow for bending when forming curved shapes, and external wood muntin bars being secured to said first and second panes in superimposed relationship relative to said internal muntin bar grid.

13. An insulated window assembly comprising:

first and second spaced apart panes of transparent sheet material;

a perimeter spacer bar positioned between said panes and extending around the perimeter of said panes and defining two pairs of opposite sides of said window assembly;

an internal muntin bar grid disposed between said first and second spaced apart panes, said muntin bar grid being formed from a nonmetallic material which is low in thermal conductivity to limit heat transfer between said first and second spaced apart panes, and is high in flexibility to allow for bending when forming curved shapes, and said muntin bar grid being U-shaped and including a base and oppositely disposed legs having outer ends positioned closely adjacent one of said first and second panes and with said base being positioned closely adjacent said other of said panes, said oppositely disposed legs of said U-shaped muntin bar being resilient to pressure from said first and second panes, said resilient legs being adapted to depress and deflect laterally under pressure from said panes moving towards each other whereby further movement of said panes is limited by said base.

14. The structure of claim 13 wherein said nonmetallic material is foam material.

* * * * *

UNITED STATES PATENT AND TRADEMARK OFFICE

CERTIFICATE OF CORRECTION

PATENT NO. : 5,345,743

DATED : Sep. 13, 1994

INVENTOR(S) : Bruce A. Baier

It is certified that error appears in the above-identified patent and that said Letters Patent is hereby corrected as shown below:

On the first page, following "Assignee:", the word "Peela" should be removed and replaced with --Pella--.

Signed and Sealed this

Seventeenth Day of February, 1998

*Attest:*

Bruce Lehman

BRUCE LEHMAN

*Attesting Officer*

*Commissioner of Patents and Trademarks*